US005117776A

United States Patent [19]

Thorpe

[11] Patent Number: 5,117,776

[45] Date of Patent: Jun. 2, 1992

[54] HYDROFOIL SYSTEM

[76] Inventor: Douglas T. Thorpe, 1715 E. Fairfield, Mesa, Ariz. 85203

[21] Appl. No.: 620,257

[22] Filed: Nov. 30, 1990

Related U.S. Application Data

[63] Continuation of Ser. No. 427,748, Oct. 26, 1989, abandoned, which is a continuation of Ser. No. 66,730, Jun. 26, 1987, abandoned.

[51] Int. Cl.[5] ..... B63B 1/30

[52] U.S. Cl. ..... 114/282; 114/274; 114/275; 114/280

[58] Field of Search ..... 114/280, 282, 284, 275; 440/56; 74/527, 529

[56] References Cited

U.S. PATENT DOCUMENTS

| | | | |
|---|---|---|---|
| 1,410,875 | 3/1922 | Bell et al. | 114/280 |
| 1,750,959 | 3/1930 | Lake | 114/282 |
| 2,214,945 | 9/1940 | Weihmiller | 114/282 |
| 3,236,202 | 2/1966 | Quady et al. | 114/282 |
| 3,294,052 | 12/1966 | Jones | 114/282 |
| 3,354,857 | 11/1967 | Hobday | 114/282 |

FOREIGN PATENT DOCUMENTS

| | | | |
|---|---|---|---|
| 497049 | 4/1930 | Fed. Rep. of Germany | 114/280 |
| 2464176 | 4/1981 | France | 114/282 |

*Primary Examiner*—Sherman Basinger
*Assistant Examiner*—Thomas J. Brahan
*Attorney, Agent, or Firm*—Joseph H. Roediger

[57] ABSTRACT

A rectractable hydrofoil for watercraft wherein a linking mechanism connects all hydrofoils to a retaining assembly. The application of an external force to a hydrofoil above a threshold causes the release of the retaining means without requiring the reaction of the operator. A control assembly within the hull is utilized by the operator to complete the movement of the hydrofoil to an aft retracted position. The retaining assembly includes a releasable securing means for maintaining the hydrofoils in the retracted position.

13 Claims, 4 Drawing Sheets

FIG. 6
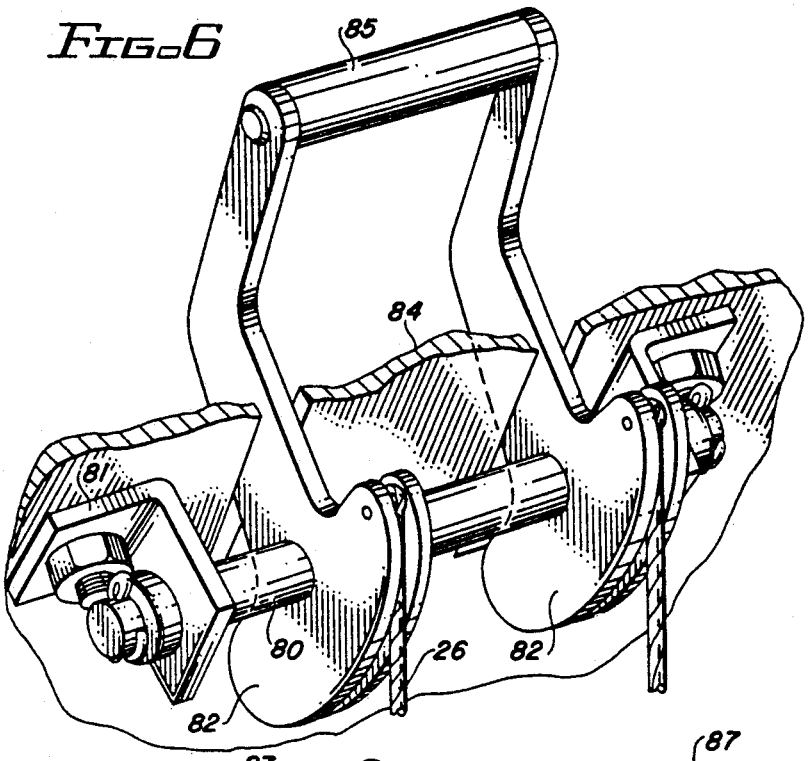
FIG. 7
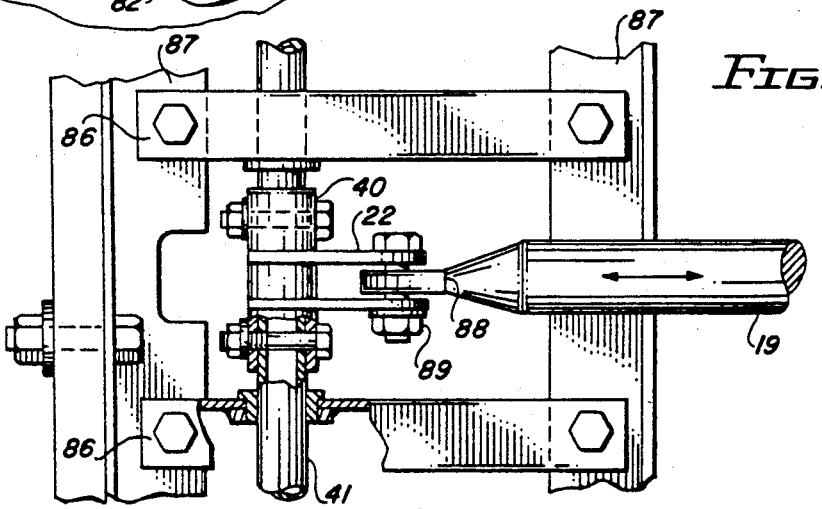
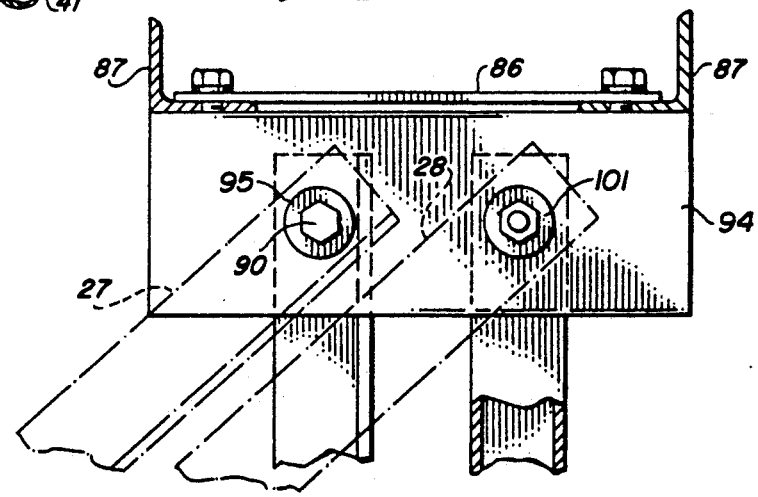
FIG. 8

HYDROFOIL SYSTEM

This is a continuation of application Ser. No. 07/427,748, filed Oct. 26, 1989, now abandoned, which is a continuation of my copending application Ser. No. 07/066,730 filed Jun. 26, 1987, now abandoned, and entitled Improved Hydrofoil System.

BACKGROUND OF THE INVENTION

This invention relates to a hydrofoil system for watercraft and, in particular, to a retractable hydrofoil system responsive to a change in external force applied to the hydrofoil.

The increasing interest in small watercraft for pleasure usage has lead to a number of individually-operated craft being promoted and sold for recreational usage. In addition to the advantage of being capable of being launched and operated by a single individual, the relative size of these watercraft is such that they can be placed on a trailer and towed from place to place without requiring specialized launching ramps and storage facilities. Thus, this watercraft can be utilized in a wide variety of bodies of water with essentially no limit to where it can be placed in the water.

One method of increasing the speed of such watercraft is to provide a hydrofoil system which operates in its intended manner to elevate the watercraft so that it can be propelled at high speed over the surface of the water. However, the versatility of these watercraft increase the likelihood that they will be operated in unfamiliar or uncharted shallow waters. Thus, the possibility of encountering hidden obstacles at a high rate of speed has generated the need for a hydrofoil system which is automatically released upon contacting such an obstacle. The speeds possible with these craft require that release take place without requiring an operator response.

Accordingly, it is an object of the present invention to provide a hydrofoil system which undergoes release from its operating position upon the application of an external force to the hydrofoil or one of its support members. In addition, the retraction apparatus of the present invention is provided with means for ensuring that the operator can manually effect retraction at any time to facilitate loading onto a trailer and subsequent transport and storage.

The subject matter of the invention is designed so that the release of the hydrofoil system takes place without requiring a response from the operator. Further, the release and subsequent retraction occur for all hydrofoils to enhance the stability of the watercraft. Further, a manual retraction mechanism is provided so that the operator can complete the retraction operation without having external force applied to the hydrofoil, thus, enabling him to beach the craft with less risk of damage to the structure.

SUMMARY OF THE INVENTION

The present invention is directed to a releasable and retractable hydrofoil system for propelled watercraft. Typically, the system finds use on small watercraft designed for an individual user. The hydrofoil system is designed to permit the watercraft to leave the water and ride on the hydrofoils upon the attaining of a sufficient speed. In effect, this frees the hull from the speed constraints determined by the equations governing maximum hull speed of a watercraft in a body of water.

The present hydrofoil system is comprised of at least one forward hydrofoil means which is pivotally mounted on the forward region of the watercraft hull. At least one aft hydrofoil means is pivotally mounted on the aft section of the hull with both hydrofoil means being mounted for rotation in the aft direction from the normal or vertical operating position. When the watercraft reaches sufficient speed with the hydrofoil means in place, the hydrofoil means supports the hull above the surface of the water and assumes a substantially vertical operating position with regard to the water surface.

The forward and aft hydrofoil means are operatively connected by a linking means located within the hull. The linking means is coupled to all hydrofoils for joint or concurrent rotation following release from the operating position to the retracted position. A first retaining means is connected to the linking means within the hull for maintaining the hydrofoils in the operating position during use. In addition, a first override means is provided for the first retaining means with the override means being responsive to the application of force to any one of the hydrofoils for causing a rapid release of the first retaining means. This override function enables the hydrofoil means to rotate from the vertical operating position toward the retracted or non-operating position.

In operation, the application of force exceeding a threshold level to the hydrofoil means may result from contact with the bottom of a shallow body of water or other hidden obstacle. This force results in a freeing of the hydrofoil means from the influence of the first retaining means without requiring operator reaction thereto. This aspect of the invention is especially well-suited for use in connection with small watercraft which are capable of attaining enhanced performance over the water surface.

A second retaining means is provided for maintaining the hydrofoil means in a retracted position. This retaining means is provided with a release mechanism which permits the operator to free the hydrofoil means from the retracted position from his position within the hull. When the watercraft is stationary, the actuation of the release causes the hydrofoils to rotate due to biasing means which urge the hydrofoils from the aft or retracted position to the normal operation position wherein they are locked into position by the first retaining means.

While the first override means provides protection against damage occurring from unanticipated external forces, a control means is provided within the hull to permit the operator to effect a manual override of the first retaining means and retract the hydrofoil means to the elevated position. This control means is directly connected to the first retaining means and enables the operator to change the mode of operation in anticipation of obstacles or to approach the shore line.

Further features and advantages of the invention will become more readily apparent from the following detailed description of the detailed embodiment of the invention when taken in conjunction with accompanying drawings.

BRIEF DESCRIPTION OF THE DRAWINGS

FIG. 6 is a perspective view of the operator control means for the embodiment of FIGS. 1 and 2.

FIG. 7 is a top view showing the connection between the linking means and the aft hydrofoil means.

FIG. 8 is a side view of the support means for a hydrofoil.

DESCRIPTION OF THE PREFERRED EMBODIMENT

Figure 1:
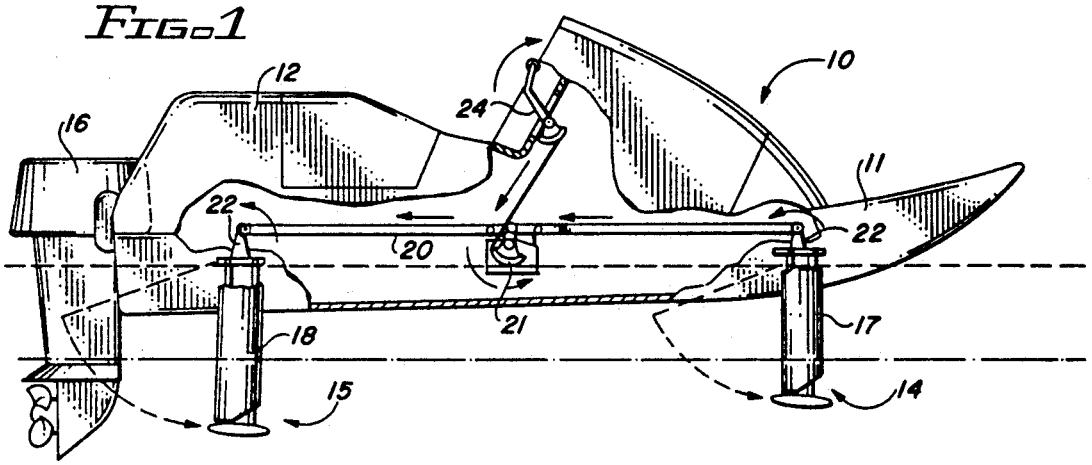
FIGS. 1 and 2 are side views in partial section showing one embodiment of the invention with the hydrofoils in the operating and retracted positions respectively.

Referring now to FIG. 1, the subject matter of the present invention is shown in combination with a small watercraft 10 which includes a hull 11 having an upper structure 12 formed thereon for accommodating the operator and perhaps one passenger. The watercraft is propelled by rear-mounted motor 16 and is adapted for travel along the surface of the water. The hull has attached thereto hydrofoil means shown as a forward hydrofoil assembly 14 and an aft hydrofoil assembly 15. Each hydrofoil assembly 14, 15 is shown with a portion of the corresponding fairing 17, 18 cut-away to display the support structure for the hydrofoil.

The hydrofoil assemblies are each pivotally mounted on the hull 11 and are interactively coupled by a linking mechanism 20 having rotational arms 22 at the opposing ends thereof. The rotational arms extend downwardly to transverse axles 41, not shown in FIGS. 1 and 2, which extend between the hydrofoils in the rear pair and in the forward pair as well. Thus, movement of the hydrofoil assemblies is caused by a corresponding movement of the linking structure 20 in the direction of the arrows of FIGS. 1 and 2 which is then translated through the rotational arms 22 via the axles to the hydrofoil assemblies.

Figure 2:
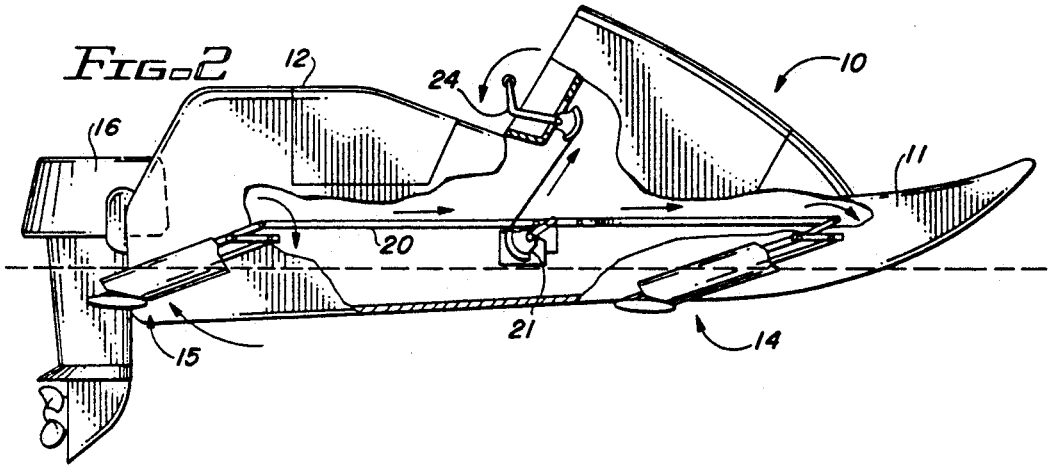

A retention assembly 21 is located intermediate the fore and aft hydrofoil assemblies and provides a means for retaining the hydrofoil assemblies in the normal or vertical operating position, shown in FIG. 1, or in the retracted position, shown in FIG. 2. The retention assembly is directly coupled to an operator control means 24 which is readily available to the watercraft operator in his normal drive position. During use, the operator changes the position of the control arm in the direction of the arrow in FIG. 2 to raise the hydrofoils from the operating to the retracted position. The hydrofoils are retained in the retracted position until released therefrom where-upon a biasing force urges them downwardly into the operating position as will later be explained in further detail. As shown in the retracted position of FIG. 2, motor 16 extends downwardly of the bottom of the hull 11 and would appear to contact any underwater obstacle that causes the release of the hydrofoil means from its normal or vertical operating position. However, a conventional automatic retraction system for the outboard drive means 16 is utilized to prevent damage to the drive system of the watercraft.

Figure 3:
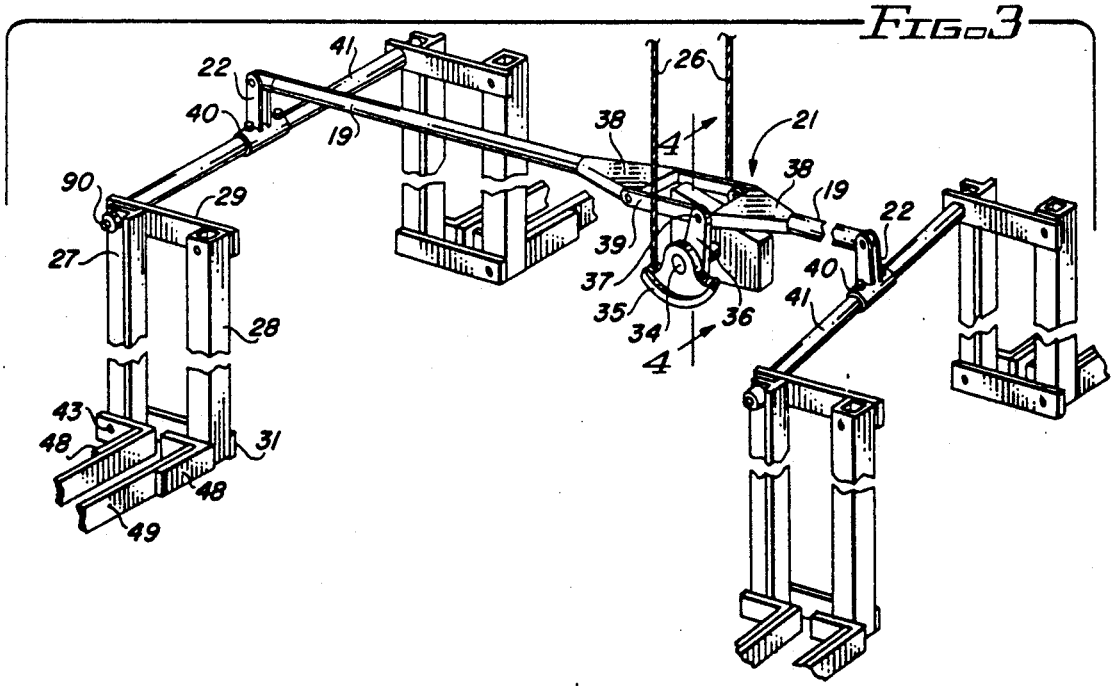
FIG. 3 is a perspective view showing the linking mechanism for the fore and aft hydrofoil means of the embodiments of FIGS. 1 and 2.

In FIG. 3, the linking mechanism extending between the fore and aft hydrofoil assemblies is shown having retention assembly 21 contained therein. The linking mechanism includes drive rods 19 extending in the fore-aft direction of the watercraft, each of which contains flared end members 38 threaded thereon and coupled by fasteners 37 to opposing sides of crank member 36. The crank member is rotationally coupled on axle 34 to cable terminating member 35. A similar construction is in place on the opposing end of axle 34. Cables 26 extend upwardly therefrom to operator control assembly 24 and the hand grippable lever operatively connected thereto for use in the retraction of the hydrofoils.

The opposing ends of linking mechanism 20 are rotationally coupled to arms 22 which terminate in a sleeve 40 affixed to transverse axle 41. Each axle 41 extends between the side braces 29 affixed to the hull of the watercraft and from which depend the hydrofoils and their movable support structure. The transverse axle 41 is journalled for rotation in the side brace 29 which is affixed to the hull. The ends of the transverse axles are fastened to the driven supports 27 for imparting the rotational force thereto. Each follower support 28 is rotationally coupled to a side brace 29 and moves in tandem with its adjacently spaced driven support. As will later be shown in further detail in FIG. 4, rotation of the control handle causes the movement of cables 26 thereby causing the linking mechanism to advance in the forward direction of the watercraft thereby imparting rotation to both transverse shafts 41.

Referring to FIG. 3, each side brace 29 has a rectangular cross section member 28 depending therefrom and aft thereof a T-shaped cross sectional member 27. A bottom cross piece 31 is rotatably fastened to the inside surfaces of downward ends of the members 27 and 28, and angle brackets 48 are rotatably fastened to the outside surfaces of members 27, 28 by bolts 43. The supporting braces 49 for the hydrofoil are attached to the angle brackets, typically by welding, and extend outwardly therefrom. The follower support member 28 is made of lightweight tubular stock, typically aluminum, and its rectangular cross-section reduces the effect of torque on the hydrofoil assembly. The driven support 27 is a T-shaped cross-sectional member which is less affected by the bending moments produced by the hydrofoil assembly during use. However, it is noted that other types of driven support configurations could be used, if desired. When the drive rods 19 are moved forward as a result of the operator control cables 26 being placed under tension, the side brace 29 is the reference point for the hydrofoil assembly and both the driven support 27 and the follower support 28 move simultaneously in the aft direction. The bottom cross piece swings aft and remains parallel to the side brace as the assembly is moved toward its retracted position. Thus, the hydrofoil remains essentially horizontal in both its normal operating and retracted positions as well as during movement therebetween.

Figure 4:
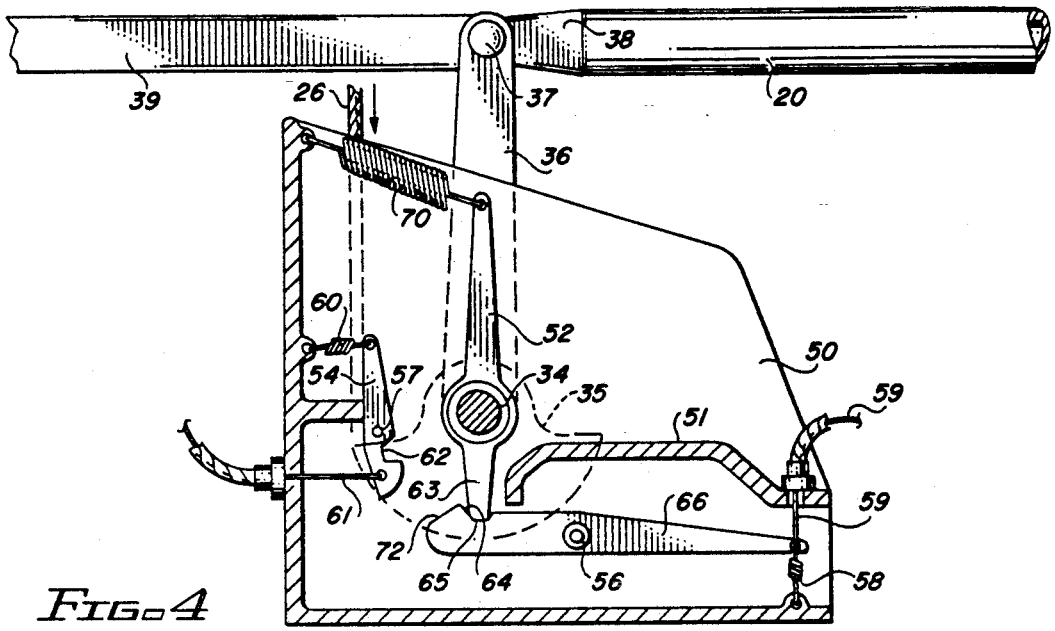
FIGS. 4 and 4*a* are cross-section views of the retention assembly in the operating and retracted hydrofoil positions respectively.

The retention assembly 21 is shown in FIG. 4 which is a side view in section taken along line 4—4 of FIG. 3. The housing 50 is affixed to either a bulkhead of the watercraft or other structural member in a conventional manner and contains the operative mechanism for establishing the retracted position of the hydrofoil assemblies. The axle 34 extends through the housing 50 and is directly connected to the linking mechanism 20. Crank 36 is rotatably coupled via fastener 37 to the flared extensions of the forward drive rod and to the tie rod 39 connected to aft drive rod 19. As a result, movement of crank 36 is directly translated into movement of the linking mechanism which is responsible for the change in position of the hydrofoil assemblies. The cable terminating member 35, shown in dashed line in FIG. 4, is coupled through cable 26 to the operator control assembly previously shown.

Retention assembly 21 includes a lever arm 52 fixedly attached to axle 34 for rotation. The lever arm 52 has a first end 63 shown received in slot 65 of movable arm 66. Arm 66 is mounted for rotation on shaft 56 which is preferably made integral with the wall of housing 50. The second or elongated end of movable arm 52 is coupled by a spring 70 to a wall of housing 50. This spring urges the first end 63 into position in the slot 65. An inwardly extending stop 51 is formed integral with housing 50 and terminates proximate to the first end of lever arm 52 when it is in the position shown in FIG. 4 corresponding to the normal operating position of the hydrofoil assemblies. This stop also limits movement of arm 66 when the first end is removed from the slot 65 and the biasing spring 58 at the opposing end of arm 66 exerts a rotational force on the arm. The position of the downward extending end of stop 51 is selected so that the angled forward surface 72 of arm 66 is always positioned to receive the first end of the lever arm 52 when it is being returned to its operating position in slot 65.

The restoring force provided by spring 70 is sufficient to cause a rotation of movable arm 66 as the first end 63 of the lever arm 52 travels along forward surface 72. Thus, the force of spring 70 drives the hydrofoils into the normal operating position. The application of this force is necessary since the movement of the hydrofoil assemblies from the retracted position shown in FIG. 2 increases the displacement of water thereby and produces a concomitant increase in buoyancy of the structure which must be overcome. It should be noted that the spring 70 causing rotation of the lever arm 52 also results in the operator control assembly being returned to its position as shown in FIG. 1 since tension is exerted on cables 26.

Figure 4A:
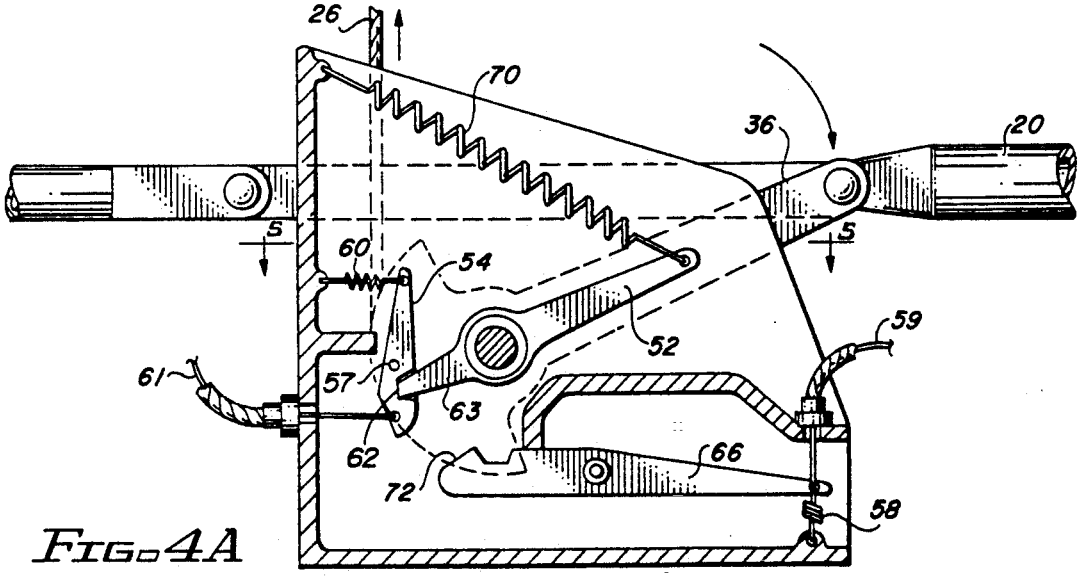

The retracted position of the hydrofoil assemblies is shown in FIG. 4A wherein the first end 63 is shown lodged in slot 62 of a second movable arm 54 mounted for rotation on shaft 57. Shaft 57 is typically made integral with a cast housing structure. As shown, the large biasing spring 70 is fully extended as a result of the operator moving the control assembly and exerting upward force on cable 26. This causes clockwise rotation of the crank 36 along with lever arm 52. As a result, the linking mechanism 20 is moved in the forward direction thereby producing rotation of the transverse axles 41. The biasing force provided by spring 60 affixed between the opposing end of arm 54 and housing 50 causes the first end of lever arm 52 to remain in slot 62 until such time as the operator exerts tension on cable 61 which then effects a release of the first end 63. The application of force by spring 70 to the opposing end of lever arm 52 causes the first end to contact the angled surface 72 of movable arm 66 as it moves in an arcuate pattern. This causes a downward movement of the forward edge of movable arm 66 and overcomes the biasing force of spring 58. This action permits the first end 63 to again seat in slot 65 as shown in FIG. 4. Further, a release cable 59 is provided to overcome the force of spring 58 when the operator desires to release the hydrofoil assemblies from the normal operating position.

An important feature of the present invention is the provision of an automatic retraction of the hydrofoils should they encounter an unexpected force during movement of the watercraft over the surface of the water. This release from the normal operating position to free the hydrofoils for aft movement takes place without requiring operator control of the retention assembly. Referring now to FIG. 4, the retention assembly is shown for the condition of normal hydrofoil operation with the first end of lever arm 52 received in slot 65 of movable arm 66. The application of force to one or more of the hydrofoil assemblies results in a transmission of this force through the support structure, transverse axle, rotational arm to the corresponding drive rod 19. This force tends to drive the linking mechanism in the forward direction. As a result, a rotational force is applied via the crank to the axle 34 and thence to the first end 63 of lever arm 52. The force at the end 63 is opposed by a moment determined by biasing means 58 and the distance between the application of the biasing force to movable arm 66 and the shaft 56. When this force is overcome, the first end 63 of lever arm 52 moves along the angled slot edge 64 and depresses that end of movable arm 66 by overcoming the biasing force of spring 58. In addition, the force exerted by axle 34 at the first end of lever arm 52 is a function of the angle of the slope of slot 65. In practice, the applied force is reduced by the sine of the angle defined by the slot edge 64 and the vertical direction. Thus, the force required to urge the hydrofoil assembly from its normal operating position for a particular dimensioned movable arm is determined primarily by the slope of the slot edge and the restoring force provided by spring 58. In practice, the threshold level force required to release the lever arm 52 from slot 65 can be readily varied for different conditions by the replacement of spring 58 with a substitute having different characteristics. The automatic release of the hydrofoil system enables hydrofoils to be utilized with a relatively high speed sport watercraft because reliance is not placed on operator reaction time for initiation. Furthermore, the release function effects all hydrofoil assemblies at the same time, thereby enhancing the stability of the watercraft during this critical period of time.

The retraction operation can be completed after the occurrence of a release action by the operator moving the hand grippable portion of a control assembly mounted on the operating panel of the watercraft. As previously mentioned, cable 59 is brought to the operating panel to provide a pull release so that the operator can effect a release independently of the application of force to the hydrofoil assemblies or the movement of the control assembly 24. It is advantageous to provide a stop on the panel when the operator puts tension on cable 59 to effect a release of the lever arm so that a relocking of the operating position under the influence of spring 70 cannot take place. This can be provided by the use of a conventional cable pull and turn locking mechanism placed on the control panel.

When the hydrofoil assemblies are in their fully retracted position as shown in FIG. 4 A, they remain locked in that position until the operator effects a release thereof by applying tension to cable 61, typically from a pull knob located on the operator panel. As soon as the release from the retracted position occurs, the restoring force of spring 60 places the movable arm 54 in position to again receive the first end 63 of lever arm 52. Since the hydrofoil assemblies are in their aft position when retracted, they are protected from the application of potentially damaging external forces during continued operation of the watercraft.

Figure 5:
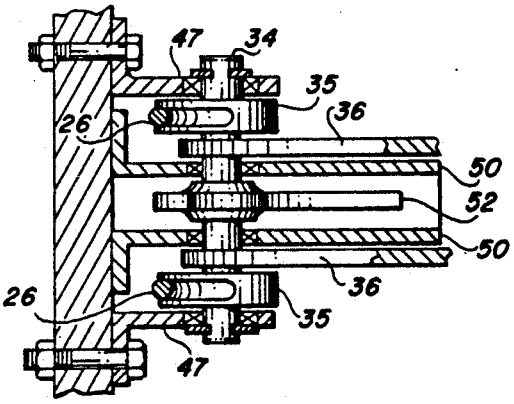
FIG. 5 is a top view in section of the retention assembly.

The axial relationship of the individual piece parts of the retention assembly 21 is shown in the partial section view of FIG. 5 taken along line 5—5 of FIG. 4A, wherein axle 34 is journalled in housing 50 and brackets 47 axially spaced therefrom. The housing is bolted to a structural member such as a bulkhead of the hull of the watercraft. The arcuate cable terminating means 35 are mounted in spaced relation on the axle 34. The cables 26, extending upwardly to the operator control assembly 24 mounted on the control panel of the watercraft, are shown in section in FIG. 5. Inwardly spaced on axle 34 are the pair of cranks 36 which are operatively connected by fasteners 37 to the linking mechanism 20 for imparting rotational force to the hydrofoil assemblies. The central portion of housing 50 is shown on either side of lever arm 52. The inner supports of housing 50 are spaced from the lever arm 52 to facilitate rotation thereof and to accommodate the spring members associated with the lever arm and the first and second movable arms.

The operator control assembly is shown in the perspective view of FIG. 6 wherein rod 80 is journalled for rotation in angle brackets 81 mounted to the control panel of the watercraft. A pair of arcuate cable terminating assemblies 82 for receiving the ends of cable 26 are secured to rod 80. As shown, the cable terminating means is made integral with a hand grippable extension 85 which extends through slots in the control panel to be readily grasped by the operator when retraction of the hydrofoil assembly is desired. Also, the pull knobs for the first and second cables 59 and 61 coupled to the movable arms of the retention assembly are ideally located nearby so the operator has access thereto.

Figure 9:
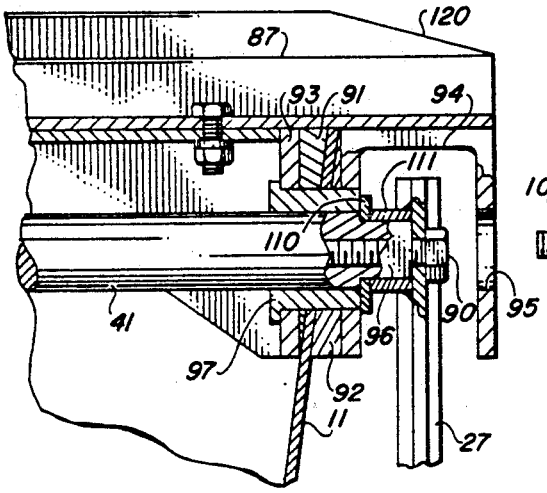
FIGS. 9 and 10 are cross-sectional views in partial section showing the mounting of the hydrofoil support means on the hull.
Figure 10:
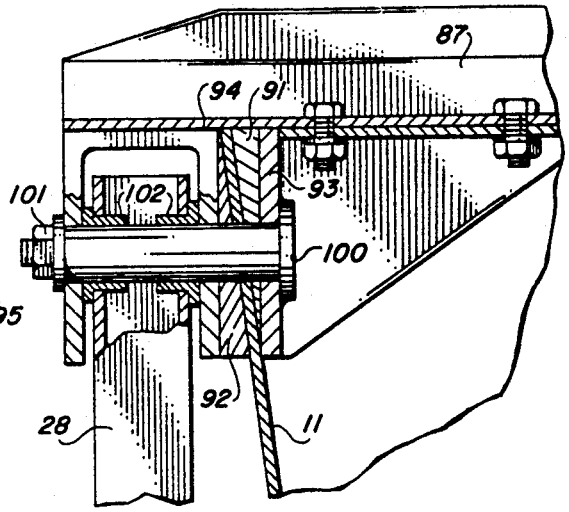

The constructional details of the interconnection between the aft drive rod 19, rotational arm 22 and aft transverse axle 41 is shown in the top view of FIG. 7, wherein a pair of spaced angle support brackets 86 are mounted between transverse L-shaped supports 87 which extend across the watercraft for rotatably supporting transverse axle 41. A removable cover, shown in FIGS. 9 and 10, is attached to the upward flanges of supports 87. While the watercraft may be configured initially to have spaced bulkheads which include these support members 86, 87 as integral parts thereof, in general it is necessary to provide transverse support members extending across the hull. As shown, the sleeve 40 is bolted to axle 41 and contains the rotational arm 22 upwardly extending therefrom. The drive rod 19 has a area of reduced section 88 with an aperture for receiving a threaded fastener 89 as shown. Thus, rotation of transverse axle 41 causes a corresponding movement of the rotational arm 22 and the application of force in the direction of the arrows to drive rod 19. Bushings located in supports 86 are sufficient to provide a low resistance rotational mounting for axle 41.

Figure 11:
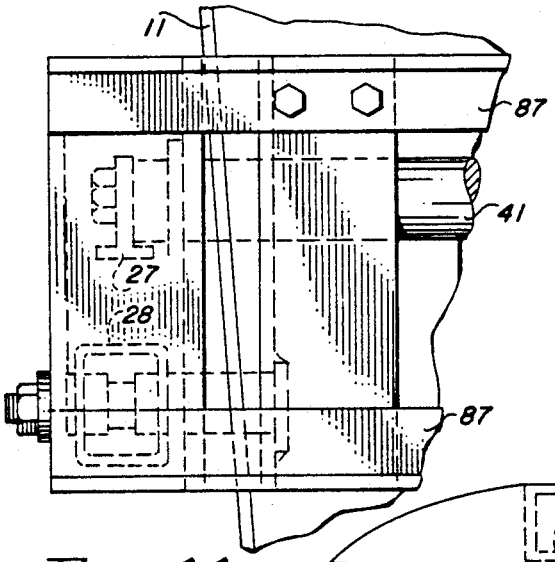
FIG. 11 is a plan view showing the orientation of the support means on the hull of the watercraft.

The upper ends of the support means for the hydrofoils is shown in FIG. 8 for the retracted hydrofoil position. The supports 87 extending transversely across the hull, noted in connection with FIG. 7, are shown extending beyond the side of the hull as shown in FIG. 11, with a support 86 extending therebetween. The driven hydrofoil support 27 is directly connected to the transverse axle 41, as can be seen more clearly from the rear view of FIG. 9, wherein in the T-shaped support member is fastened by bolt 90 to the end of the axle.

As shown in FIG. 9, the ends of axle 41 have a reduced cross-sectional area which in the embodiment tested and operated was machined to a rectangular cross-section so that it would fit adjacent to the flange of support member 27. Bushing 97 surrounds the round surface of axle 41 proximate to the end and a hole, to receive bushing and axle, is provided in the combination of end plate 93, shims 91 and 92, and the portion of hull 11 extending therebetween. The end plate 93 and adjacent shim are figuratively shown as side brace 29 in FIG. 11. An inverted U-shaped bracket 94 is secured to the combination on the outside of the hull and to the overlying supports 87 by suitable fastening means not shown. Protective cover 120 is affixed to the flanges of supports 87. In assembly, the bushing 97 is inserted from the inside of the watercraft and extends to the outer surface of the adjacent portion of the U-shaped bracket 94. Adjacent outer washer 110, protective sleeve 111, rectangular in shape, is placed over the reduced area section of axle 41 and provide increased bearing area to transfer torsion in axle 41 into support 27. The bolt 90 is threaded into the axle 41 as shown. The U-shaped bracket 94 is provided to reduce the likelihood of an obstacle interfering with the release and retraction of the hydrofoils during use. Access port 95 is provided in bracket 94 to facilitate removal of the hydrofoil by the use of a socket wrench or the like.

The driven support 28 having a rectangular cross-section is shown mounted within the U-shaped bracket in FIG. 10. This view is taken from the forward portion of the hull looking aft and shows the combination of shims and U-shaped bracket previously discussed in connection with FIG. 9. A bolt 100 with associated bushings is received in a hole in support 28 and extends therethrough to accommodate a threaded fastener 101 which is accessible without requiring removal of the U-shaped bracket. Thus, both support structures can be unfastened from the watercraft without requiring a dismantling of the support structure. In practice, gussets are provided for support where needed as shown in FIGS. 9 and 10. The necessity and location for such supports is determined primarily by the manner of construction of the watercraft utilizing the present invention.

Figure 12:
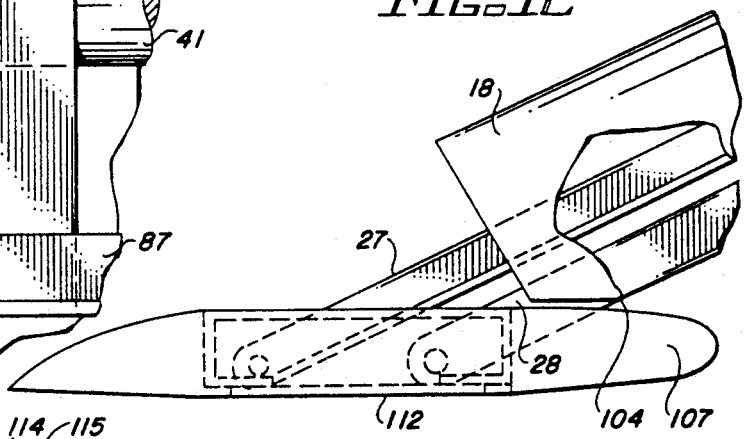
FIG. 12 is a side view in partial section showing the hydrofoil attachment to the support means.
Figure 13:
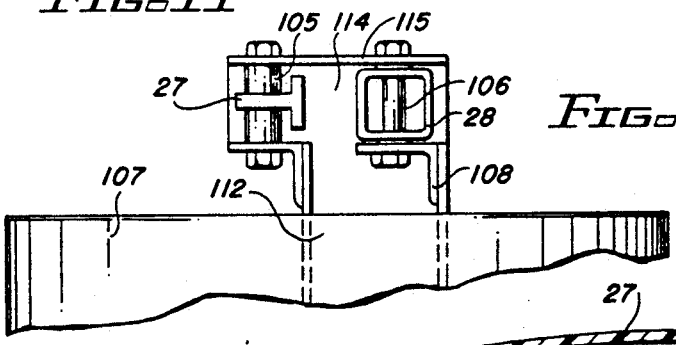
FIG. 13 is a top view in section of the support means at the hydrofoil.
Figure 14:
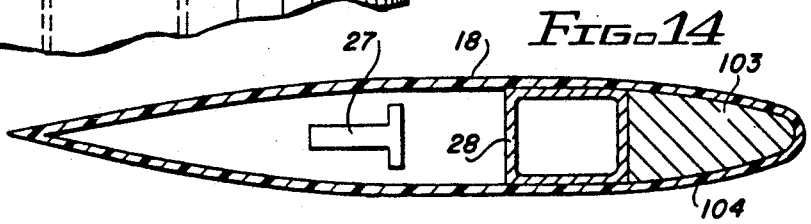
FIG. 14 is a view in section of the fairing for the support means taken along line 14 of FIG. 12.

The orientation of the two hydrofoil support structures is further shown in the top view of FIG. 11 with the cover removed. The fastening means and cross-sections of the two adjacent supports 27, 28 for a particular hydrofoil are shown in dashed outline. The support members 87 are noted as extending transversely across the watercraft and extend outwardly therefrom to provide the support for U-shaped bracket 94. In the preferred embodiment of the invention, the downwardly extending support members are covered by a fairing structure which decreases water resistance by providing a smooth contoured exterior. The cross-section of the fairing is shown in FIG. 14 wherein a fiberglass hydrodynamic shape is affixed to the walls of driven support 28 and includes a reinforcing nose 103 which may be made of wood if desired. The structure formed of fiberglass does not contact the driven support 27 which is free to move between its operating and retracted positions. The retracted position of hydrofoil 107 is illustrated in FIG. 12 wherein the support structures 27 and 28 remain parallel as they are moved from the vertical operating position in the aft direction. The fairing 18 has a chamfer 104 at its leading edge to ensure that the hydrofoil 107 does not contact the fairing 18 as it moves from its operating position to its retracted position. It is to be noted from FIG. 12 that the ends of supports 27 and 28 are rounded to accommodate the fasteners 105 and 106 respectively which rotatably secure the hydrofoil to the support structures. In FIG. 13, a top sectional view is shown of the constructional features of the outward extension of hydrofoil base member 112. Since hydrofoils of different shape can be purchased commercially, the description of the hydrofoil construction is not within the scope of the present invention and FIG. 11 shows the modification to the outward extension of the hydrofoil support base to accommodate the supports 27 and 28 in the embodiment described. The receiving means for the end of the support structures is shown comprising first and second angle brackets 108, preferably welded to the U-shaped support base 112 which is preferably formed integral with horizontal base member 114 and has an outer upstanding flange 115. The fasteners 105 and 106 are typically nut-bolt combinations extending through corresponding apertures in the ends of supports 27 and 28. Thus, the hydrofoil is affixed to the ends of the supports 27 and 28 which are permitted to rotate in tandem as the hydrofoil moves from its normal operating position to the release position and then to the fully retracted position. During this period, the hydrofoil 107 remains substantially horizontal as shown in FIGS. 1 and 2.

While the foregoing description has referred to a particular embodiment of the invention which permits the hydrofoils to be simultaneously released from a normal operating position without requiring operator action, it is recognized that many modifications and variations in the constructional features thereof may be made without departing from the scope of the invention as claimed.

What I claim is:

1. A retractable hydrofoil system for propelled watercraft which comprises:

a) a hull having forward and aft regions;

b) forward hydrofoil means movably mounted on the forward region of said hull;

c) aft hydrofoil means movably mounted on the aft region of said hull, the forward and aft hydrofoil means being mounted for rotation from an operating position to a retracted position, said aft hydrofoil means including:

i. first and second aft support means rotatably affixed at one end thereof to said hull at opposing transverse locations thereon;

ii. a hydrofoil affixed to the free end of said first and second aft support means respectively, and iii. transverse connecting means extending between said first and second aft support means;

d) linking means coupled to the forward and aft hydrofoil means for joint rotation thereof;

e) first retaining means for maintaining the forward and aft hydrofoil means in the operating position during movement of the hull; said first retaining means including:

i. a lever arm having first and second ends and being centrally mounted for rotation, said lever arm being connected to said linking means for imparting movement thereto, and ii. a first movable arm having a first end and containing a slot spaced from said first end thereof by an angled surface, said slot receiving said first end of the lever arm;

f) first override means responsive to the application of force to at least one of said forward and aft hydrofoil means for releasing said lever arm and enabling the forward and aft hydrofoil means to rotate from said operating position;

g) second retaining means for maintaining said forward and aft hydrofoil means in the retracted position;

h) release means operatively connected to said second retaining means for permitting movement of the forward and aft hydrofoil means from the retracted position upon actuation of said release means;

i) first biasing means operatively connected to said first movable arm for maintaining said forward and aft hydrofoil means in the operating position; and j) control means connected to said first retaining means for overriding said first retaining means to permit movement of the forward and aft hydrofoil means from the operating position.

2. The hydrofoil system in accordance with claim 1 further comprising second biasing means coupled to the lever arm for applying a force thereto urging the first end along said angled surface of said first movable arm into engagement with the slot thereof.

3. The hydrofoil system in accordance with claim 2 wherein said second biasing means includes a spring coupled between a fixed support and the second end of said lever arm.

4. The hydrofoil system in accordance with claim 3 wherein said override means includes an angled edge formed in the slot in said first movable arm to facilitate release of said first retaining means therefrom.

5. The hydrofoil system in accordance with claim 4 wherein the angled edge of said slot has a slope that is greater than the slope of said angled surface whereby the force required to release said hydrofoil system from the operating position exceeds the force required to urge the hydrofoil system into said operating position.

6. The hydrofoil system in accordance with claim 5 wherein the first movable arm is mounted for rotation about a centrally-located axis and said first biasing means is connected to said movable arm for inhibiting rotation thereof.

7. The hydrofoil system in accordance with claim 6 wherein the threshold level for said override means is primarily determined by the angled edge of said slot and the first biasing means.

8. The hydrofoil system in accordance with claim 7 wherein said second retaining means comprises a second movable arm having a slot in one end thereof for receiving the first end of said lever arm, said second arm being spaced from the first end of the lever arm to establish the retracted position of said hydrofoil means.

9. The hydrofoil system in accordance with claim 8 wherein said release means is connected to the second movable arm for releasing the lever arm therefrom and thereby permitting said hydrofoil means to move from the retracted position.

10. The hydrofoil system in accordance with claim 9 wherein said first and second aft support means each include a pair of spaced members rotatably mounted on the outer surface of the hull and a hydrofoil rotatably mounted on the opposing ends of said pair of spaced members, the spaced members being perpendicular to the hydrofoil in the operating position and being angularly disposed thereto in the retracted position.

11. The hydrofoil system in accordance with claim 10 wherein said transverse connecting means extends between corresponding ones of the pairs of spaced members, movement of the linking means causing rotation of said transverse connecting means and said aft hydrofoils.

12. The hydrofoil system in accordance with claim 11 wherein said forward hydrofoil means include first and second forward support means each including a pair of spaced members rotatably mounted on the outer surface of the hull and a hydrofoil rotatably mounted on the opposing ends of a pair of said members, the spaced members being perpendicular to the hydrofoil in the operating position and being angularly disposed thereto in the retracted position and transverse connecting means extending therebetween.

13. The hydrofoil system in accordance with claim 12 wherein said transverse connecting means extends between corresponding ones of the pairs of spaced members, said linking means being connected to said transverse connecting means so that movement thereof imparts rotation to said transverse connecting means and said forward hydrofoils.

* * * * *